US012708212B2

(12) United States Patent
Remelts et al.

(10) Patent No.: US 12,708,212 B2
(45) Date of Patent: Aug. 18, 2026

(54) BACK ATTACHMENT

(71) Applicant: Steelcase Inc., Grand Rapids, MI (US)

(72) Inventors: Matthew David Remelts, Grand Rapids, MI (US); Richard L. Russell, Jr., Shelbyville, MI (US); Brett W. Fischer, Grandville, MI (US)

(73) Assignee: Steelcase Inc., Grand Rapids, MI (US)

( * ) Notice: Subject to any disclaimer, the term of this patent is extended or adjusted under 35 U.S.C. 154(b) by 148 days.

(21) Appl. No.: 18/734,502

(22) Filed: Jun. 5, 2024

(65) Prior Publication Data

US 2024/0407553 A1 Dec. 12, 2024

Related U.S. Application Data

(60) Provisional application No. 63/506,458, filed on Jun. 6, 2023.

(51) Int. Cl.
*A47C 7/40* (2006.01)

(52) U.S. Cl.
CPC ..... *A47C 7/40* (2013.01)

(58) Field of Classification Search
CPC ..... A47C 7/40
See application file for complete search history.

(56) References Cited

U.S. PATENT DOCUMENTS

| | | | |
|---|---|---|---|
| 1,355,669 | A | 10/1920 | Henry |
| 2,461,055 | A | 2/1949 | Meyer |
| 2,611,423 | A | 9/1952 | Blum |
| 2,943,373 | A | 7/1960 | Rapata |
| 3,037,814 | A | 6/1962 | Gardner et al. |
| 3,295,891 | A | 1/1967 | Brown |
| 3,556,592 | A | 1/1971 | Antoine |
| 4,099,774 | A | 7/1978 | Sandham |
| 4,390,210 | A | 6/1983 | Wisniewski et al. |
| 4,830,435 | A | 5/1989 | Nemschoff et al. |
| 5,018,789 | A | 5/1991 | Sheckells |
| 5,067,772 | A | 11/1991 | Koa |

(Continued)

FOREIGN PATENT DOCUMENTS

| | | | |
|---|---|---|---|
| DE | 202010008360 | U1 | 12/2010 |
| EP | 0125598 | A2 | 11/1984 |

(Continued)

*Primary Examiner* — Philip F Gabler
(74) *Attorney, Agent, or Firm* — Price Heneveld LLP

(57) ABSTRACT

A chair component includes curved first and second shells respectively including first and second apertures spaced across the inner and outer shells, and a plurality of fasteners configured to extend into the first plurality of apertures and the second plurality of apertures, wherein at least some of the apertures of the first plurality of apertures of the first shell or at least some of the apertures of the second plurality of apertures of the second shell are elongated and wherein the plurality of apertures of the other of the first shell or the second shell are substantially round, and wherein the fasteners of the plurality of apertures received within the elongated apertures are configured to slide along a length of the elongated apertures as the first and second shells are pressed together and the plurality of fasteners extend into the first plurality of apertures and the second plurality of apertures.

23 Claims, 5 Drawing Sheets

(56) References Cited

U.S. PATENT DOCUMENTS

| | | | | |
|---|---|---|---|---|
| 5,102,196 | A * | 4/1992 | Kaneda | A47C 3/12 297/285 |
| 5,110,186 | A | 5/1992 | Clark et al. | |
| 5,152,582 | A | 10/1992 | Magnuson | |
| 5,201,108 | A | 4/1993 | Clark et al. | |
| 5,222,852 | A | 6/1993 | Snyder | |
| 5,326,155 | A | 7/1994 | Wild | |
| 5,769,498 | A | 6/1998 | Smith et al. | |
| 5,779,317 | A | 7/1998 | Neal | |
| 5,842,264 | A | 12/1998 | Roossien et al. | |
| 5,934,758 | A | 8/1999 | Ritch et al. | |
| 6,065,810 | A | 5/2000 | Koenig et al. | |
| 6,652,030 | B2 | 11/2003 | Conner et al. | |
| 7,111,906 | B2 | 9/2006 | Heisey et al. | |
| 7,159,293 | B2 | 1/2007 | Coffield et al. | |
| 7,604,298 | B2 * | 10/2009 | Peterson | A47C 7/40 297/440.1 |
| 9,050,690 | B2 | 6/2015 | Hammer et al. | |
| 9,144,311 | B2 * | 9/2015 | Romero | A47C 1/03255 |
| 9,398,811 | B1 | 7/2016 | Williams et al. | |
| 11,291,305 | B2 | 4/2022 | Deevers et al. | |
| 2017/0231396 | A1 * | 8/2017 | Beyer | A47C 7/462 297/284.7 |
| 2020/0332819 | A1 | 10/2020 | Matthes et al. | |
| 2020/0345142 | A1 * | 11/2020 | Battey | A47C 1/0308 |
| 2021/0093092 | A1 * | 4/2021 | Deevers | A47C 7/462 |
| 2022/0395100 | A1 | 12/2022 | Snyder et al. | |

FOREIGN PATENT DOCUMENTS

| | | | |
|---|---|---|---|
| JP | 4800754 | B2 | 10/2011 |
| JP | 6082570 | B2 | 2/2017 |
| JP | 6282084 | B2 | 2/2018 |

* cited by examiner

BACK ATTACHMENT

CROSS-REFERENCE TO RELATED APPLICATIONS

This application claims priority to U.S. Provisional Patent Application No. 63/506,458, entitled "BACK ATTACHMENT," filed Jun. 6, 2023, the entire disclosure of which is incorporated herein by reference.

BACKGROUND OF THE INVENTION

The embodiments as shown and described herein relate to a chair component, and in particular to a chair component that includes curved shells having apertures configured to allow associated fasteners to be positionally adjusted with respect to the shells during coupling of the shells to one another.

SUMMARY OF THE INVENTION

One embodiment as shown and described herein includes a chair component that includes a first shell including a plurality of first apertures spaced across the first shell, the first shell being curved, a second shell including a second plurality of apertures spaced across the second shell, the second shell being curved, and a plurality of fasteners configured to extend into the first plurality of apertures and the second plurality of apertures, wherein at least some of the apertures of the first plurality of apertures of the first shell or at least some of the apertures of the second plurality of apertures of the second shell are elongated and wherein the plurality of apertures of the other of the first shell or the second shell are substantially round, and wherein the fasteners of the plurality of apertures received within the elongated apertures are configured to slide along a length of the elongated apertures as the first and second shells are pressed together and the plurality of fasteners extend into the first plurality of apertures and the second plurality of apertures.

Another embodiment as shown and described herein may include a method of assembling a chair component that includes providing the chair component as described above, inserting the plurality of fasteners into the elongated apertures, and connecting the first shell with the second shell by aligning the first plurality of apertures with the second plurality of apertures and moving the first an second shells toward one another such that the plurality of fasteners are received within the substantially round apertures and the plurality of fasteners slide along the length of the elongated apertures as the first and second shells move toward one another.

Yet another embodiment as shown and described herein may further or alternatively include a chair component that includes an inner shell including a plurality of first apertures spaced across the inner shell where at least some of the apertures of the first plurality of apertures are substantially round, the inner shell being curved, an outer shell including a second plurality of apertures spaced across the outer shell where at least some of the apertures of the second plurality of apertures are elongated, the inner shell being curved, and a plurality of quick connect fasteners extending into the first plurality of apertures and the second plurality of apertures, wherein the fasteners of the plurality of apertures received within the elongated apertures are configured to slide along a length of the elongated apertures as the first and second shells are pressed together and the plurality of fasteners extend into the second plurality of apertures.

Still yet another embodiment as shown and described herein may include a method of assembling a chair component that includes providing the chair component as described above, inserting the plurality of fasteners into the elongated apertures, and connecting the inner shell with the outer shell by aligning the first plurality of apertures with the second plurality of apertures and moving the inner and outer shells toward one another such that the plurality of fasteners are received within the substantially round apertures and the plurality of fasteners slide along a length of the elongated apertures as the inner and outer shells move toward one another.

Another embodiment as shown and described herein may further or alternatively include a chair component that includes an inner shell including a plurality of first apertures spaced across the inner shell, the inner shell being curved, an outer shell including a second plurality of apertures spaced across the outer shell, the inner shell being curved, and a plurality of quick connect fasteners extending into the first plurality of apertures and the second plurality of apertures, wherein at least a portion of the plurality of fasteners are configured to slide along a length of at least some of the second plurality of apertures while remaining stationary along a length of at least some of the first plurality of apertures as the first and second shells are pressed together and the plurality of fasteners extend into the second plurality of apertures.

Yet another embodiment as shown and described herein may include a method of assembling a chair component that includes providing the chair component as described above, inserting the plurality of fasteners into the elongated apertures, and connecting the inner shell with the outer shell by aligning the first plurality of apertures with the second plurality of apertures and moving the inner and outer shells toward one another such that the plurality of fasteners is received within the at least some of the first plurality of apertures and the plurality of fasteners slide along the length of the at least some of the second plurality of apertures as the inner and outer shells move toward one another.

The embodiments as shown and described herein provide a chair component that allows multiple curved shell members to be easily and quickly coupled to one another without the use of specialized tools, allows for prefabrication of the components, reduces assembly time, reduces manufacturing costs, reduces the chances or possibilities of misalignment and mis-assembly of the associated elements or parts, and is particularly well adapted for the proposed use.

These and other advantages of the embodiments as disclosed and described herein will further be understood and appreciated by those skilled in the art by reference to the following specification, claims and appended drawings.

DETAILED DESCRIPTION OF PREFERRED EMBODIMENT

Figure 1:
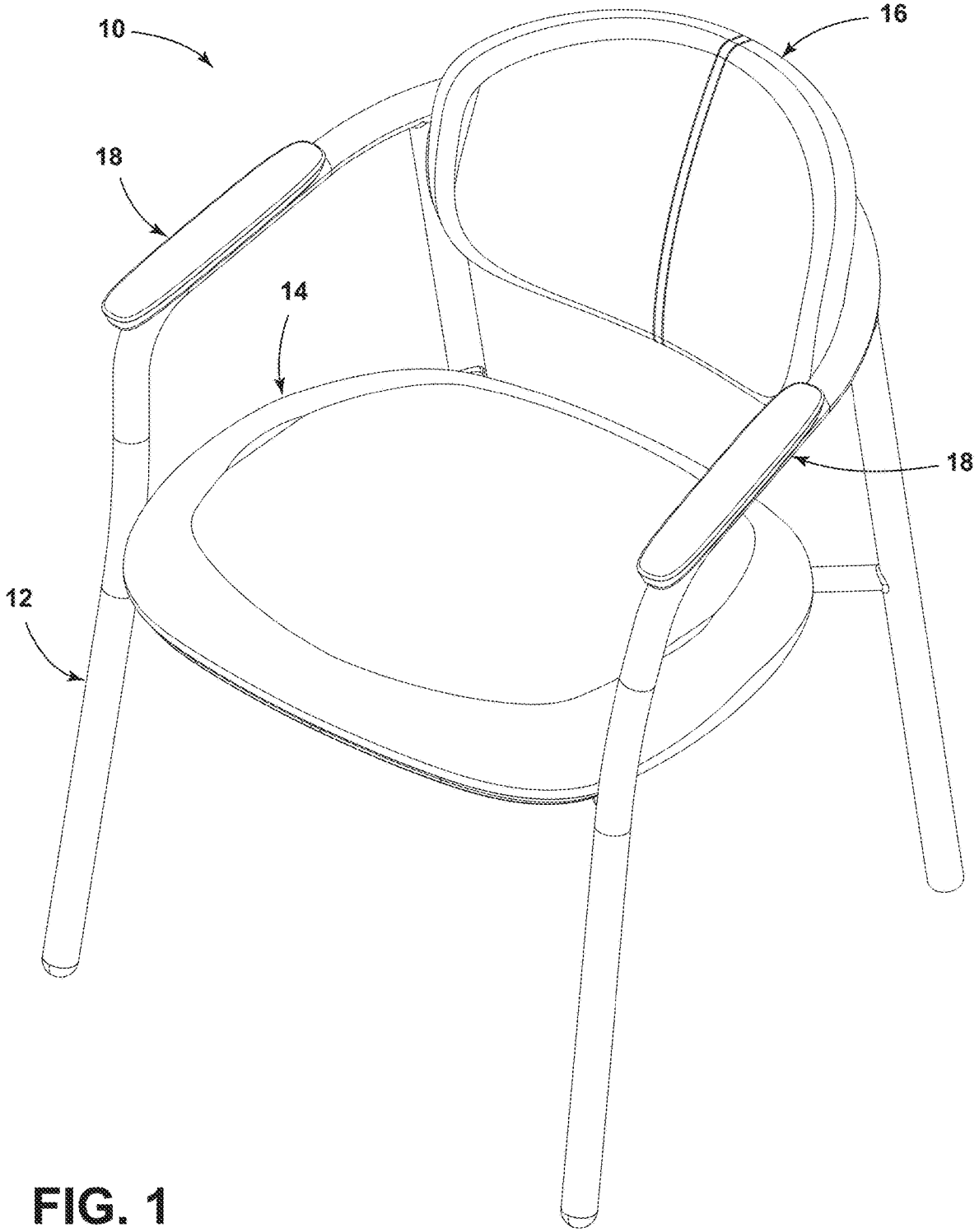
FIG. 1 is a perspective view of a chair assembly that includes a back assembly embodying certain aspects of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

Figure 2:
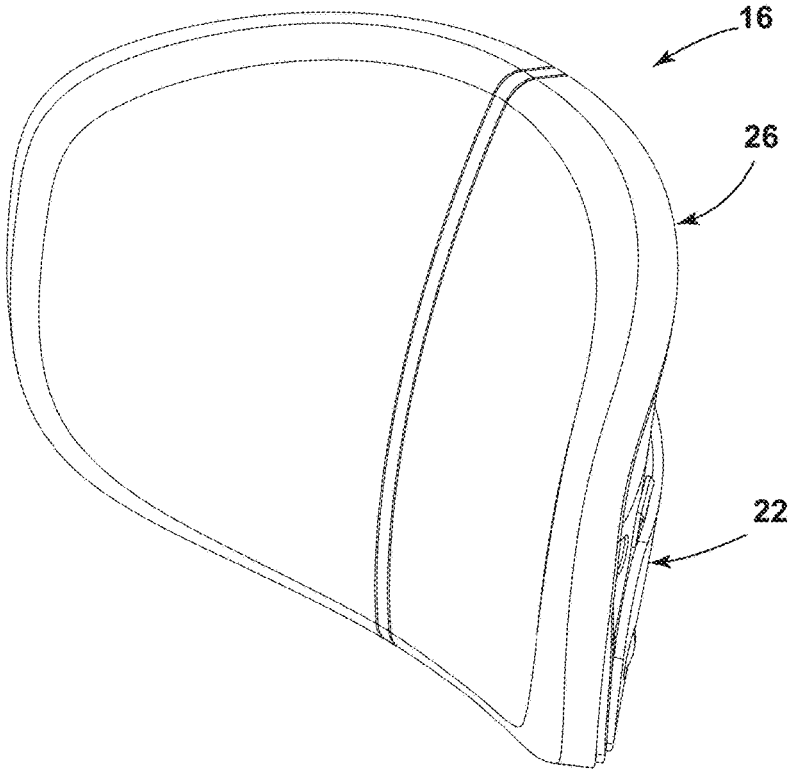
FIG. 2 is a perspective view of the back assembly.
Figure 3:
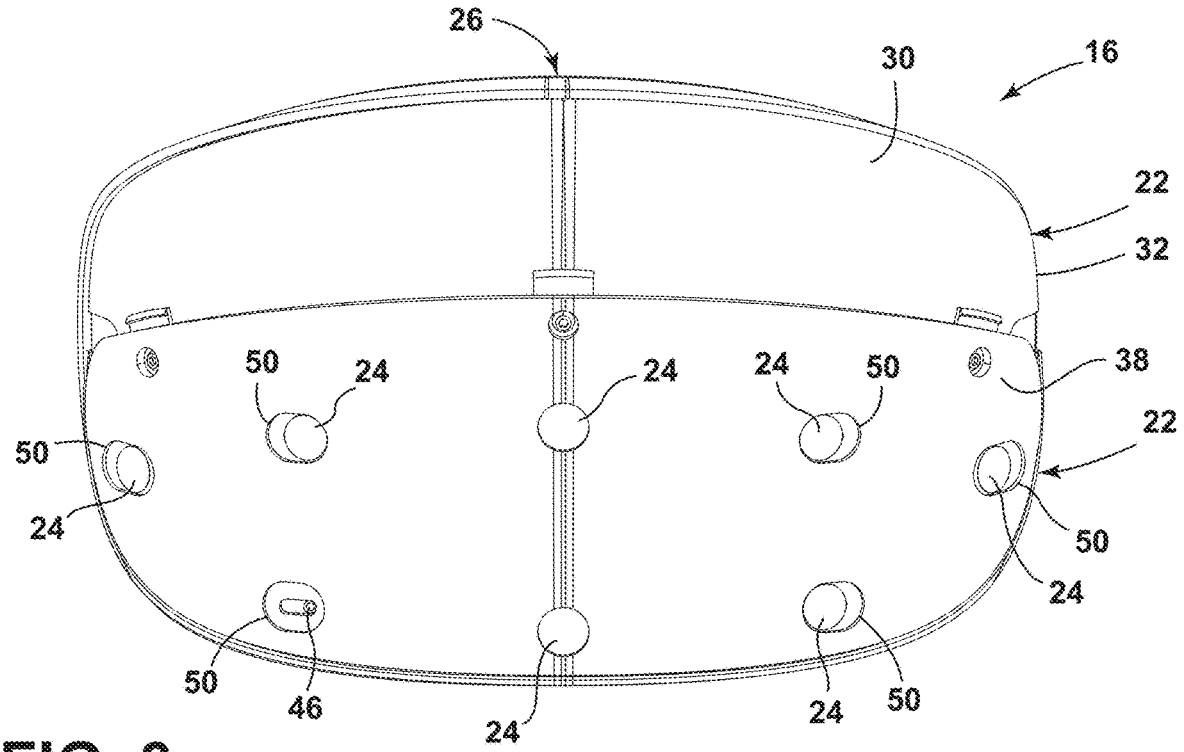
FIG. 3 is a rear elevation view of the back assembly.
Figure 4:
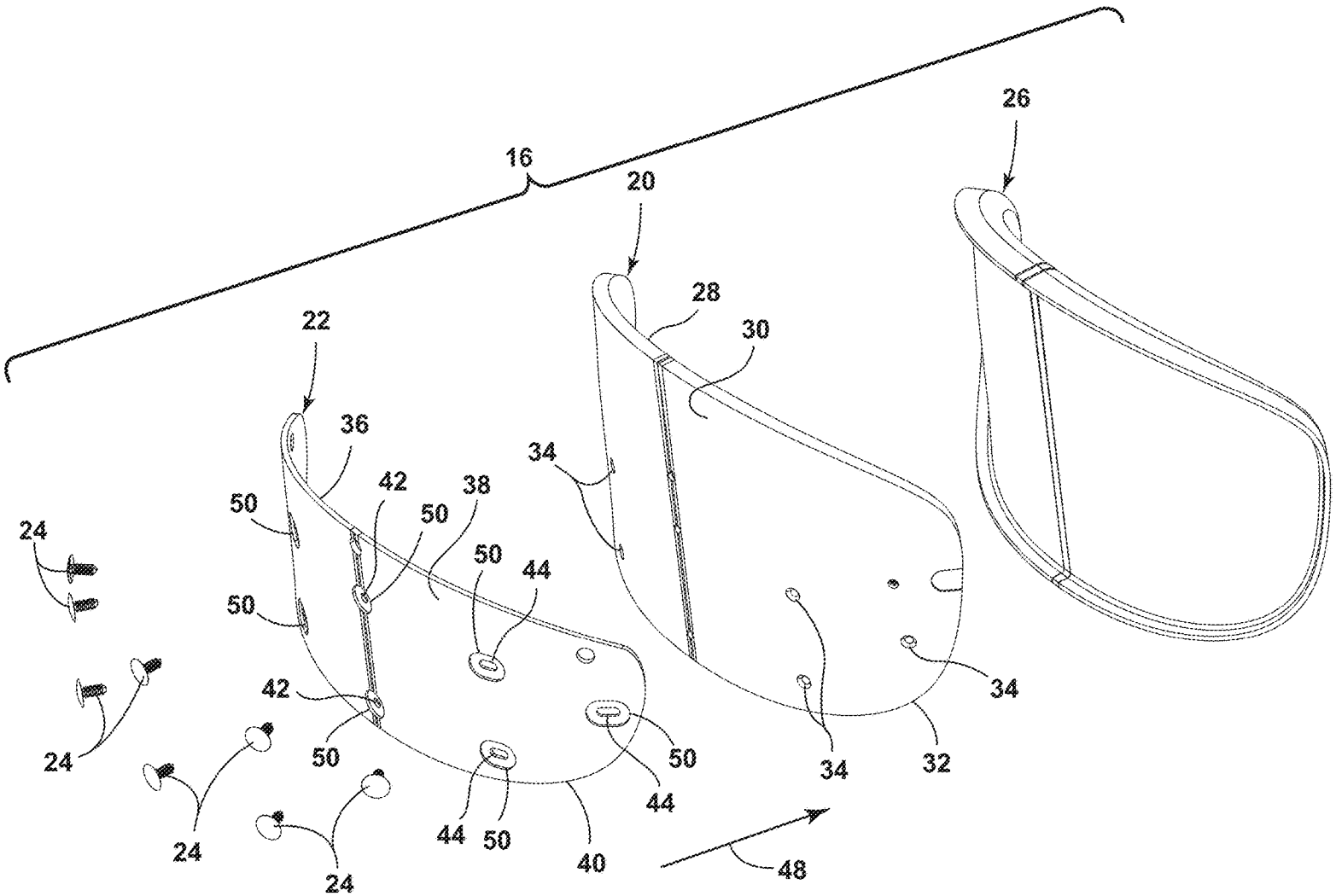
FIG. 4 is an exploded perspective view of the back assembly.
Figure 5:
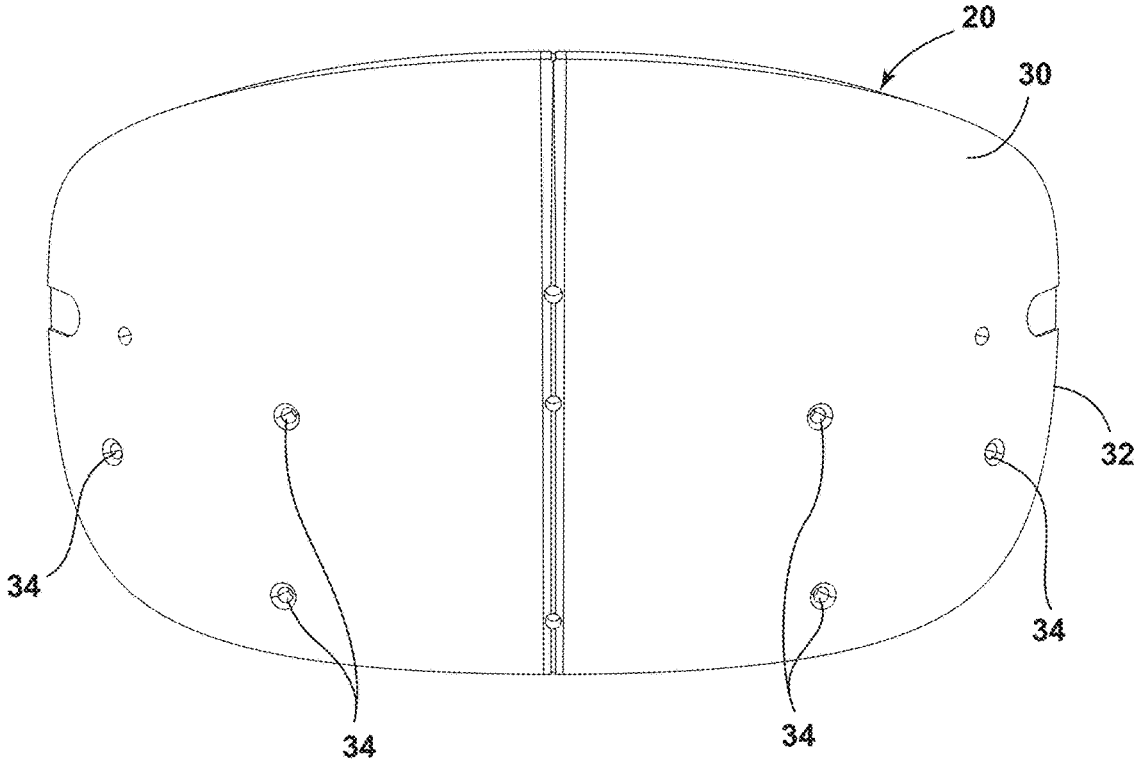
FIG. 5 is a rear elevation view of an inner shell of the back assembly.
Figure 6:
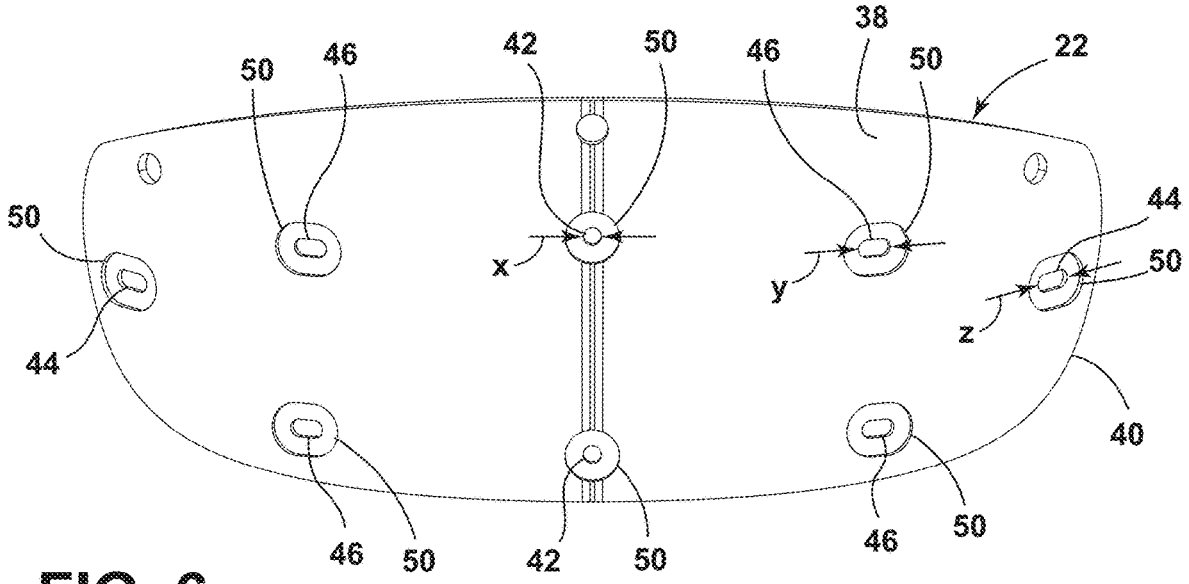
FIG. 6 is a rear elevation view of an outer shell of the back assembly.

The reference numeral 10 (FIG. 1) designates a chair assembly that includes a frame assembly 12 supporting a seat assembly 14, a back assembly 16 and a pair of arm supports 18. The back assembly 16 (FIGS. 2-4) is an example of a chair component configured to allow easy and quick assembly of the various elements thereof. In the illustrated example, the back assembly 16 includes an inner shell 20, an outer shell 22, a plurality of fasteners 24 configured to attach the outer shell 22 to the inner shell 20, and a cushion member 26 configured to comfortably support a seated user thereon.

In the illustrated example, the inner shell 20 includes a front surface 28, a back surface 30 and an outer peripheral edge 32. As shown, the inner shell 20 is curved across a width thereof, however, the curvature of the inner shell 20 could extend in other or multiple directions. A plurality of apertures 34 are spaced across the width of the inner shell 20 from one another and extend through the inner shell 20 between the front surface 28 and the back surface 30. In the illustrated example, the apertures 34 of the inner shell 26 have a circularly-shaped cross-sectional configuration, although other configurations may be utilized. The inner shell 20 may comprise a semi rigid plastic, however other suitable materials may also be utilized, including completely rigid materials.

The outer shell 22 includes a front surface 36, a rear surface 38 and an outer peripheral edge 40. As shown, the outer shell 22 is curved across a width thereof where the curvature of the outer shell 22 is similar to the curvature of the inner shell 20 such that the inner shell 20 can be closely nested within the outer shell 22. As noted above with respect to the inner shell 20, the curvature of the outer shell 22 may extend in other or multiple directions, and preferably is configured so as to match the curvature of the inner shell 20 so as to allow nesting in close proximity therewith. The outer shell 22 includes a plurality of apertures, including central apertures 42 located along a lateral centerline of the outer shell 22, outer apertures 44 positioned toward the proximal lateral ends of the outer shell 22, and intermediate apertures 46 positioned laterally between the central apertures 42 and respective outer apertures 44. The apertures 42, 44, 46 extend through the outer shell 22 between the front surface 36 and the rear surface 38. In the illustrated example, the central apertures 42 each have a circularly-shaped cross-sectional configuration with a diameter X, while the outer apertures 44 and the intermediate apertures 46 are each elongated, where the length Z of the outer apertures 44 are relatively longer than the length Y of each of the intermediate apertures 46, such that the width of the respective apertures increases the further the respective aperture is located from the lateral center of the outer shell 22. The elongation of the outer apertures 44 and the intermediate apertures 46 allows the respective fasteners 24 received therein to slide along a length of the apertures 44, 46 as the inner shell 20 and the outer shell 22 are coupled or attached to one another, as further described below. The outer shell 22 may comprise a semi rigid plastic, however other suitable materials may also be utilized, including completely rigid materials.

In the illustrated example, the fasteners 24 include quick-connect type fasteners, and in particular Christmas tree-type fasteners, although other fasteners suitable for coupling the inner shell 20 to the outer shell 22 may be utilized.

Figure 7B:
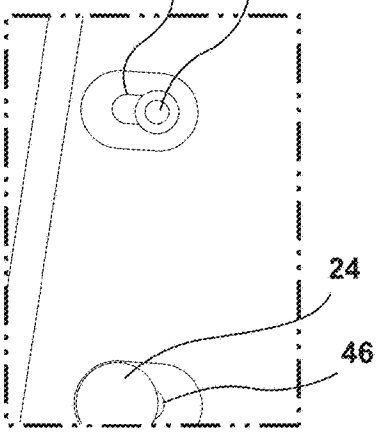
FIG. 7B is an enlarged rear elevation view of the area VIIB, FIG. 7A.
Figure 8B:
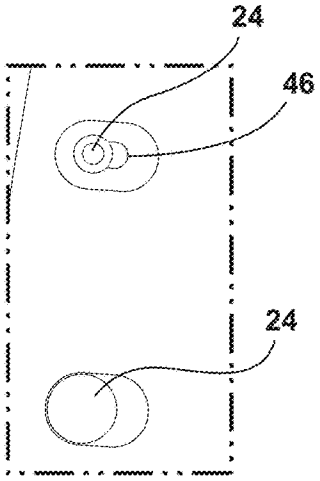
FIG. 8B is an enlarged rear elevation view of the area VIIIB, FIG. 8A.
Figure 7A:
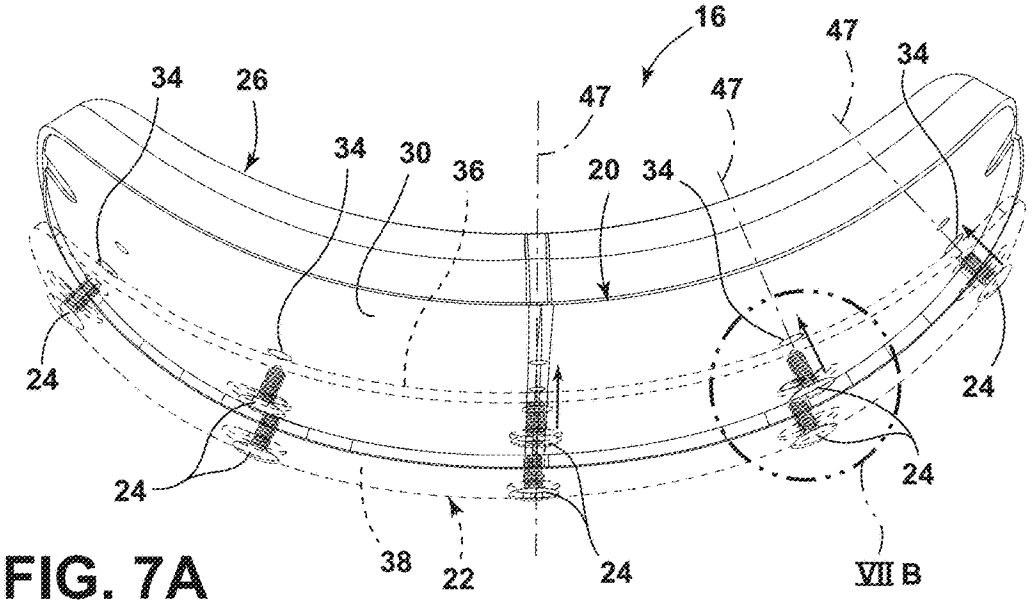
FIG. 7A is a top plan view of the back assembly.
Figure 8A:
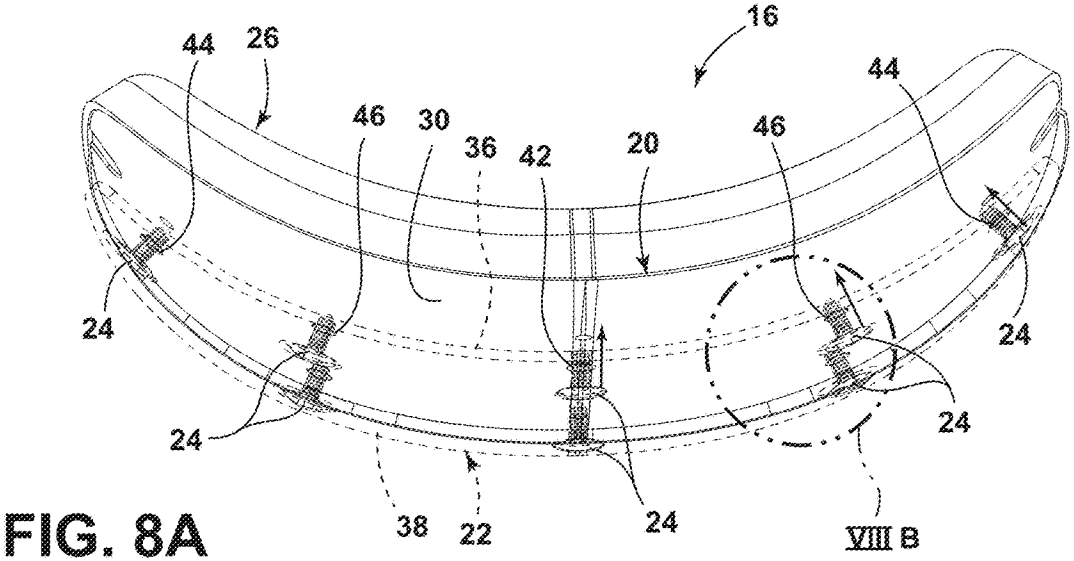
FIG. 8A is a top plan view of the back assembly.

In assembly, fasteners 24 (FIGS. 7A-8B) are placed within and extend through the apertures 42, 44, 46 of the outer shell 22 such that the longitudinal axis 47 of the fasteners 24 received within the respective apertures 42, 44, 46 extend in different directions from one another. The outer shell 22 is then positioned with respect to the inner shell 20 such that the apertures 42, 44, 46 of the outer shell 42 are aligned with the respective apertures 34 of the inner shell 20. The outer shell 22 is then moved in a direction 48 until the fasteners 24 are located within and extend through the apertures 34 of the inner shell 20. As the outer shell 22 is moved in the direction 48 toward the inner shell 20 during assembly, the curvature of the inner shell 20 and the outer shell 22 causes the respective fasteners 24 to be received within the outer apertures 42 and the intermediate apertures 46 such that the fasteners 24 are allowed to and forced to slide along a length of the outer apertures 44 and the intermediate apertures 46 (FIGS. 7B and 8B), thereby allowing the outer shell 24 to be attached to the inner shell 20 without flexing either the inner shell 20 or the outer shell 22, and further allows pre-assembly of the fasteners 24 within the apertures 34 of the outer shell 22 prior to alignment of the outer shell 22 with the inner shell 20. The outer shell 22 may further include recesses 50 located about each of the apertures 42, 44, 46 thereby allowing flush mounting of the fasteners 24 with the rear surface 38 of the outer shell 22. The cushion member 26 is assembled with and/or about the inner shell 20 and the outer shell 22 such that the cushion member 26 covers at least a portion of the front surface 28 of the inner shell 20. The cushion member 26 may be secured to the inner shell 20 and the outer shell 22 via an adhesive, mechanical fasteners, a cover member (not shown), and the like.

In the foregoing description, it will be readily appreciated by those skilled in the art that modifications may be made to the embodiments as described and shown herein without departing from the concepts generally disclosed herein. Such modifications are to be considered as included in the following claims, unless these claims by their language expressly state otherwise.

The invention claimed is:

1. A chair component, comprising:

a first shell including a first plurality of apertures spaced across the first shell, the first shell being curved;

a second shell including a second plurality of apertures spaced across the second shell, the second shell being curved; and a plurality of fasteners configured to extend into the first plurality of apertures and the second plurality of apertures;

wherein at least some of the apertures of the first plurality of apertures of the first shell or at least some of the apertures of the second plurality of apertures of the second shell are elongated and wherein the plurality of apertures of the other of the first shell or the second shell are substantially round, and wherein the fasteners of the plurality of fasteners received within the elongated apertures are configured to slide along a length of the elongated apertures as the first and second shells are pressed together and the plurality of fasteners extend into the first plurality of apertures and the second plurality of apertures and wherein the first and second shells are configured to remain unflexed as the fasteners received within the elongated apertures slide along the length of the elongated apertures.

2. The chair component of claim 1, wherein the first shell is curved across a width of the first shell and the second shell is curved across a width of the second shell.

3. The chair component of claim 1, wherein a length of each of the elongated apertures varies across a width of the shell that includes the elongated apertures.

4. The chair component of claim 1, wherein a length of the elongated apertures varies across the first shell.

5. The chair component of claim 1, wherein the plurality of fasteners includes quick connect fasteners.

6. The chair component of claim 1, wherein the first shell includes an inner shell that includes the apertures that are substantially round, and wherein the second shell includes an outer shell that includes the apertures that are elongated.

7. The chair component of claim 1, wherein the first plurality of apertures extends entirely through the first shell.

8. The chair component of claim 7, wherein the second plurality of apertures extends entirely through the second shell.

9. A method of assembling a chair component, comprising:

providing the chair component of claim 1;

inserting the plurality of fasteners into the elongated apertures; and connecting the first shell with the second shell by aligning the first plurality of apertures with the second plurality of apertures and moving the first and second shells toward one another such that the plurality of fasteners are received within the substantially round apertures and the plurality of fasteners slide along the length of the elongated apertures as the first and second shells move toward one another.

10. A chair component, comprising:

an inner shell including a first plurality of apertures spaced across the inner shell where at least some of the apertures of the first plurality of apertures are substantially round, the inner shell being curved;

an outer shell including a second plurality of apertures spaced across the outer shell where at least some of the apertures of the second plurality of apertures are elongated, the outer shell being curved; and a plurality of quick connect fasteners extending into the first plurality of apertures and the second plurality of apertures;

wherein the quick connect fasteners received within the elongated apertures are configured to slide along a length of the elongated apertures as the inner and outer shells are pressed together and the plurality of quick connect fasteners extend into the second plurality of apertures, and wherein the inner shell and the outer shell are each configured to remain unflexed as the inner and outer shells are pressed together.

11. The chair component of claim 10, wherein the inner shell is curved across a width of the inner shell and the outer shell is curved across a width of the outer shell.

12. The chair component of claim 10, wherein the length of at least some of the elongated apertures varies across a width of the outer shell.

13. The chair component of claim 10, comprising:

a cushion attached to the inner shell opposite the outer shell.

14. The chair component of claim 10, wherein the first plurality of apertures extends entirely through the inner shell and second plurality of apertures extend through the outer shell.

15. A method of assembling a chair component, comprising:

providing the chair component of claim 10;

inserting the plurality of fasteners into the elongated apertures; and connecting the inner shell with the outer shell by aligning the first plurality of apertures with the second plurality of apertures and moving the inner and outer shells toward one another such that the plurality of quick connect fasteners is received within the substantially round apertures and the plurality of fasteners slide along a length of the elongated apertures as the inner and outer shells move toward one another.

16. A chair component, comprising:

an inner shell including a first plurality of apertures spaced across the inner shell, the inner shell being curved;

an outer shell including a second plurality of apertures spaced across the outer shell, the outer shell being curved; and a plurality of quick connect fasteners extending into the first plurality of apertures and the second plurality of apertures;

wherein at least a portion of the plurality of quick connect fasteners are configured to slide along a length of at least some of the second plurality of apertures while remaining stationary along a length of at least some of the first plurality of apertures as the first and second shells are pressed together and the plurality of quick connect fasteners extend into the second plurality of apertures and wherein the inner shell and the outer shell are each configured to remain substantially unflexed as the at least portion of the plurality of quick connect fasteners slide along the length of the at least some of the second plurality of apertures.

17. The chair component of claim 16, wherein the at least some of the second plurality of apertures are elongated, and wherein the at least some of the first plurality of fasteners are round.

18. The chair component of claim 16, wherein the inner shell is curved across a width of the inner shell and the outer shell is curved across a width of the outer shell.

19. The chair component of claim 16, wherein a length of at least some of the elongated apertures varies across a width of the outer shell.

20. The chair component of claim 16, wherein the plurality of quick connect fasteners includes Christmas tree-type fasteners.

21. The chair component of claim 16, wherein the first plurality of apertures extends entirely through the inner shell and second plurality of apertures extend through the outer shell.

22. The chair component of claim 16, wherein the chair component comprises a chair back.

23. A method of assembling a chair component, comprising:

providing the chair component of claim 16;

inserting the plurality of quick connect fasteners into the elongated apertures; and connecting the inner shell with the outer shell by aligning the first plurality of apertures with the second plurality of apertures and moving the inner and outer shells toward one another such that the plurality of quick connect fasteners is received within the at least one of the first plurality of apertures and the plurality of quick connect fasteners slide along the length of the at least some of the second plurality of apertures as the inner and outer shells move toward one another.

* * * * *